United States Patent [19]

Fulop et al.

[11] 4,071,097

[45] Jan. 31, 1978

[54] PROCESS AND APPARATUS FOR SUPERSONIC DRILLING IN UNDERGROUND ROCKY STRATA

[75] Inventors: Miklós Fülöp; Géza Rákár, both of Budapest, Hungary

[73] Assignee: Koolaj es Foldgazbanyaszati Ipari Kutato Laboratorium, Budapest, Hungary

[21] Appl. No.: 582,249

[22] Filed: May 30, 1975

Related U.S. Application Data

[63] Continuation-in-part of Ser. No. 322,750, Jan. 11, 1973, abandoned.

[51] Int. Cl.[2] ..... E21B 7/04; E21B 9/08

[52] U.S. Cl. ..... 175/56; 175/340

[58] Field of Search ..... 175/55, 56, 340; 141/319

[56] References Cited

U.S. PATENT DOCUMENTS

| | | | |
|---|---|---|---|
| 2,163,240 | 6/1939 | Hofmann | 141/319 |
| 2,902,258 | 9/1959 | Hildebrandt | 175/56 |
| 2,951,682 | 9/1960 | Boucher | 175/56 |
| 3,094,176 | 6/1963 | Cook | 175/56 X |
| 3,138,213 | 6/1964 | Brandon | 175/56 |
| 3,163,240 | 12/1964 | Bodine | 175/56 |
| 3,251,424 | 5/1966 | Brooks | 175/56 |
| 3,346,058 | 10/1967 | Bouyoucos | 175/56 |
| 3,405,770 | 10/1968 | Galle et al. | 175/56 |

FOREIGN PATENT DOCUMENTS

| | | | |
|---|---|---|---|
| 724,906 | 2/1955 | United Kingdom | 175/56 |

OTHER PUBLICATIONS

Maurer W. C., *Novel Drilling Techniques* NY Pergamon Press, 1968, p. 44–49.

*Primary Examiner*—Ernest R. Purser
*Assistant Examiner*—Richard E. Favreau

[57] ABSTRACT

Process and apparatus for the ultrasonic treatment of underground rocky strata, primarily for drilling therein, and for increasing the permeability of the strata. A flushing medium is made to flow through a mechanical drilling tool such as a rotary drill bit with rock-breaking elements, a pressure wave is superposed on the static pressure of the flowing medium at the location of rock breaking, and the frequency of the pressure wave in the ultrasonic range, preferably between 20 and 100 kHz; good results have been obtained at 27 kHz. The inventive apparatus includes a passageway in the tool for the flushing medium, a resonance chamber in the path of the medium, together with an exciting or interference element, constituting means for changing the flow conditions of at least part of the medium from laminar to turbulent, producing therein a pressure wave, and superposing the latter, as aforesaid. The resonance chamber preferably opens into a jet nozzle forming part of the drilling tool. The ultrasonic frequency may be set to be equal to at least the natural or resonance of the rock-breaking element, or to be an integral multiple of that frequency.

10 Claims, 5 Drawing Figures

PROCESS AND APPARATUS FOR SUPERSONIC DRILLING IN UNDERGROUND ROCKY STRATA

This is a continuation-in-part of Ser. No. 322,750, filed Jan. 11, 1973 by the same inventors, titled "Equipment for Supersonic Drilling of Rocky Strata Below the Surface", now abandoned.

The invention concerns a process and an apparatus for the ultrasonic treatment of underground strata, primarily for drilling therein, and/or for increasing the permeability of rocky strata.

In order to exploit saturated liquids or gases in such strata, generally a rotary, turbo-rotary or mud-drilling method is employed. Such a method is described for example in Hungarian Pat. No. 153,021.

The basis of breaking down rocks is the generation of a stress in the rock, by means of a suitable drilling tool, which exceeds the strength of the rock so that individual rock portions snap off. Drilling methods exist wherein the breaking off of rock parts is promoted also by the creation of various erosion effects. The various drilling methods all achieve break-up of the rock by generating tensile and shear stresses.

To bring the drill cuttings (drilled matter) to the surface, to counterbalance the pressure of the strata, and to cool the boreholes, a suitably chosen bore mud or cleaning — flushing medium is used; hereinafter the term "mud" or "medium" will be used. All these materials have relatively high specific gravity with which the drill-hole is filled up and which, during the various case pulling operations, is caused to stream through the borehole.

One of the tasks of the medium is to protect the bore section that has not been secured by casing against stress conditions in the rock, which are disturbed during the deepening of the borehole and which subsequently rearrange themselves.

A change in the pressure head of the mud causes a change in the stress conditions of the rock in the vicinity of the borehole wall. Pressure changes that have not been planned in advance or have not been considered fully may involve a disturbance in the borehole wall of a magnitude such that it is not possible at all, or only with great difficulty, to prevent a blow-out or to stabilize the borehole wall.

The energy requirements of the mechanical processes are very considerable and, in addition, the rate of advance of drilling depends considerably on the strength characteristics of the rock, so that the rate of advance is generally limited.

The more recent requirements relating to hydrocarbon exploration and exploitation have brought out the unconditional necessity of finding more efficient drilling processes with faster drilling speeds.

A process is known wherein, in the interest of cleaning the bottom of the hole, the mud or medium is fed at high velocity to the location of rock breaking (jet drilling).

Experiments have also been made to break rock by employing ultrasonics, wherein a probe-like tool was used to break the rock exclusively by the mechanical effect or action of ultrasound. This process, however, requires an extraordinarily high ultrasonic energy input and, besides, the larger pieces torn off the rock adversely influence the efficiency of the process. At the same time, these experiments have not found widespread use on an industrial scale.

In using currently available technologies, problems arise also by the fact that the flushing and filling liquids employed in opening up the rock cause blockages. The main reasons for this are the following:

A. The swelling of clay minerals in clay-containing layers, under the effect of the liquids.

B. The increase in the connate water content of the layer.

C. The pore-blocking effect of filtrates filtering into the layers.

These phenomena greatly reduce the original permeability of the strata.

Permeability generally decreases to 25 to 40% of the original value. In some cases permeability may practically even disappear. After finishing the well formation and before beginning production, the re-establishment of permeability may be attempted by various strata-treatment processes. The performance of such treatment is, however, complicated and, moreover, due to the agressive and corrosive media employed, also has an adverse effect on the wall structure. It provides no solution at all for re-establishing permeability reduced by clay tumefaction, see for example Hungarian Patent Nos. 158,047 and 161,901.

It is the object of the present invention to develop a new drilling method with an expedient change in the pressure of the medium for filling up the borehole to the end that the efficiency of the individual operational steps in the drilling technology is increased so that the pressure change occurs only in the location of the desired operational step while the course of this change is periodic, from the physical point of view of the rock strata.

According to one of the important features of the invention, the object is achieved by providing in the drilling tool at least one cavity resonator and/or an exciting or interference element, tuned — according to the invention — to an ultrasonic frequency, more particularly in the flow path of the flushing medium.

When drilling with the inventive process and apparatus, at the location of rock breaking there is superposed, on the static pressure of the flushing medium, a pressure wave of a frequency preferably equal to the natural or resonance frequency or an integral multiple thereof, of the inherent vibration of the rock-breaking elements of the tool, as will be explained later, the pressure-wave frequency preferably falling in the ultrasonic range, as mentioned before.

When applying these frequencies, the damping of the ultrasonic waves is minimal, and thus the stresses produced in the rock by each tooth of the drill bit are enhanced. The rate of advance of drilling performed in this way is nearly double the rate of advance of conventional mechanical drilling, and its magnitude depends less on the characteristics of the rock than in the case of the mechanical procedure.

In respect of the natural or resonance frequency mentioned somewhat earlier the following explanations are appropriate. A rotary drill bit can be regarded in these respects as a reed generator. It is known that the drill stem vibrates longitudinally due to the motion of the rock-breaking elements. Reed frequencies of such drill stems are defined in a known manner by the number of rock-breaking elements or cones, of the teeth therein, and of the revolution of the drill stems per minute. The longitudinal vibration can be ascertained and registered by means of a simple acceleration gage that produces electric signals proportional to the acceleration of the drill stem. A curve can thus be plotted that corresponds to the vibrating motion of the stem. Such curves are periodical but not strictly sinusoidal. The frequency of such a curve changes as a function of the number of cones, teeth and the rpm of the drill stem. For example, if the speed is doubled, the frequency also increases to its twofold.

The periodical, non-sinusoidal curve can be produced by the superposition of several sinusoidal curves of different frequencies. The frequencies of such components can be determined by a so-called selective tube voltmeter, the output signal of the acceleration gage being fed to such a voltmeter. Then, continuously turning the frequency control knob, the output signal can be registered. A signal can thus be obtained which shows differing amplitudes for different frequencies; the peaks show the frequencies of the sinusoidal components of the non-sinusoidal curve. These peak frequencies are, at the same time, the natural frequencies of the drill bit being examined.

If it is desired to increase the permeability of the rock strata, then, in the course of the treatment, there is superposed, on the static pressure of the medium streaming through the tool, a pressure wave the frequency of which is preferably in the ultrasonic range and which is equal to or equal to an integral multiple of the natural resonant frequency at the depth of the strata that should be treated. The pressure wave is applied with a principal direction of propagation identical with the angle of inclination of the strata, while the local natural frequency of the latter is determined by the permeability conditions and/or the dimensions of artificial cavities in the strata. The process may also be used in combination with other, known processes.

The natural frequency of strata can be defined, in a known manner, by the following equation:

$$f = (\rho \cdot c/E)\ [1/\text{sec}]$$

wherein $\rho$ is the density of the strata, $c$ is the velocity of propagation of sound, and $E$ is the modulus of elasticity.

As to propagation identical with the inclination of the strata, this means that the propagation of the ultrasonic waves should follow the median plane of the strata.

According to major features of the present invention, a flushing medium is made to flow through the drilling tool such as a rotary drill bit, through a passageway and a resonance chamber constituting part of the passage, and superposing a pressure wave on the static pressure of the flowing medium at the location of rock breaking, the frequency of the pressure wave being set in the ultrasonic range, more specifically between 10 and 100 kHz.

The pressure wave is preferably set to approx. 27 kHz. Basically, the frequency of the pressure wave should be made equal to at least the natural (= resonance) frequency of the rock-breaking element, or be set to an integral multiple of that natural frequency. To achieve the suggested pressure wave, the diameter of the resonance chamber is preferably chosen to be approx. 22 millimeters, its length being approx. 30 millimeters.

At least one interference element is used in the inventive apparatus. The flushing medium is preferably made to flow through the passageway with a volume of approx. 1700 liters per minute, the medium having a specific weight of approx. 1.32 kp/cu.dm and a flow resistance of 25 dynes/sq.cm. The loss of pressure of the medium in passing by the interference elements is between 25 and 30 atmospheres.

According to an optional feature of the invention the superposing step is carried out at a depth of the strata with a principal direction of propagation that is identical with the inclination of the strata, the local natural frequency of the latter being determined from the permeability conditions of the strata and/or the dimensions of artificial cavities therein as was explained before.

The resonance chamber may have two or three portions, which contribute to the above-mentioned flow resistance to the flushing medium so as to achieve a loss in its pressure.

The resonance chamber may open into a jet nozzle which forms part of the drilling tool. In a specific structural arrangement, the latter is in the form of a roller bit commercially known under the designation A – 1 type, of 8½ inch, while the jet nozzle has a diameter of approx. 14 millimeters.

Other objects, features and advantages of the inventive process and apparatus will become better understood by reference to the following description when considered in conjunction with the accompanying drawings wherein FIG. 1 is a sectional view through an exemplary drilling tool, with one rock-breaking element, embodying the features of the present invention;

Figure 1:
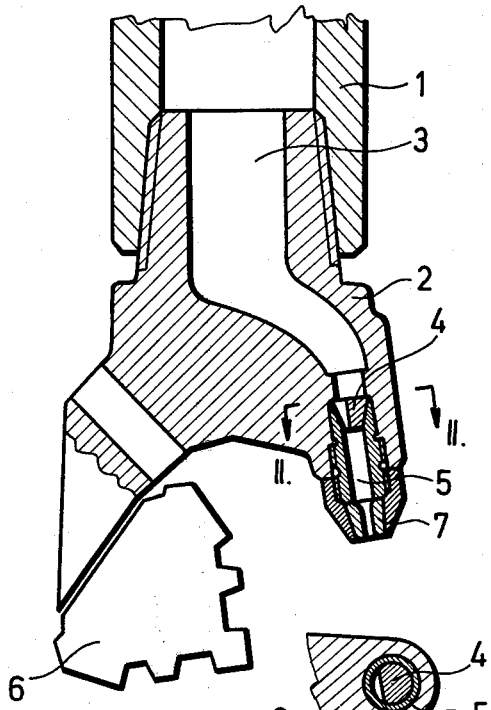

In an ultrasonic drilling apparatus according to the invention, a flushing substance flows on the action of a conventional pump (not shown) through a bore rod or drill stem 1, and it reaches, through conventional main channels or passageways 3 in a drilling tool 2 (in the example illustrated, a roller drill), an annular space between a rock-breaking element in the form of a roller cone 6 and the borehole. Actual work is done by this element. A nozzle 7 ensures a suitable bottom cleaning or flushing speed to the medium.

Figure 2:
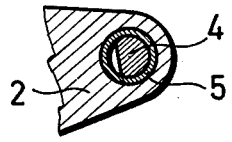
FIG. 2 is a partial sectional view of a portion in the element, taken along line 2 — 2 of FIG. 1, known as a fluid whistle.
Figure 3:
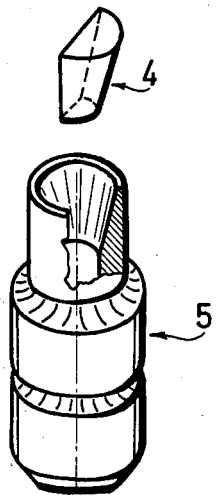
FIG. 3 is a somewhat enlarged perspective view of the parts shown in FIG. 2, namely an exciting or interference element and a cavity resonator or chamber.

As can best be seen from the FIGS. 2 and 3, an exciting or interference element 4, preferably a so-called fluid whistle, is placed above the nozzle 7 (as viewed in FIG. 1) and above a suitable exciting space, preferably a cavity resonator or resonator chamber 5 in an outer portion of the passageway 3, between the interference element 4 and the nozzle 7, which ensure the excitation of the vibrations.

The dimensions of the chamber 5 are preferably chosen by taking into account the flow and the rheological characteristics of the medium so as to ensure an appropriate vibration frequency in the ultrasonic range. It is necessary in this respect to know the velocity of sound propagation in the medium. The resonator 5 is preferably made two- or three-part, as will be explained, thereby to present the necessary flow resistance to the flushing medium flowing therethrough.

Figure 4:
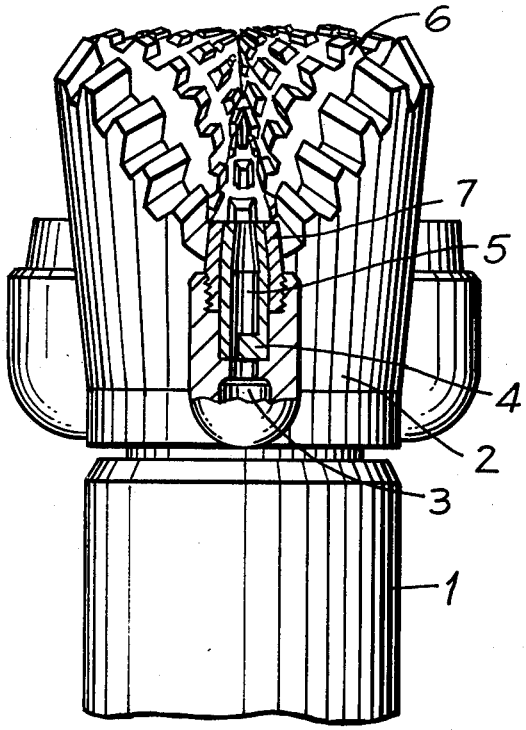
FIG. 4 is a somewhat schematic side view of a drilling tool having three interference elements therein (reversed as to its top and bottom portions when compared to the somewhat similar view of FIG. 1); and, FIG. 5 is an end view of the bottom of the three-part drilling tool of FIG. 4 (that is, viewed from the top of that figure).
Figure 5:
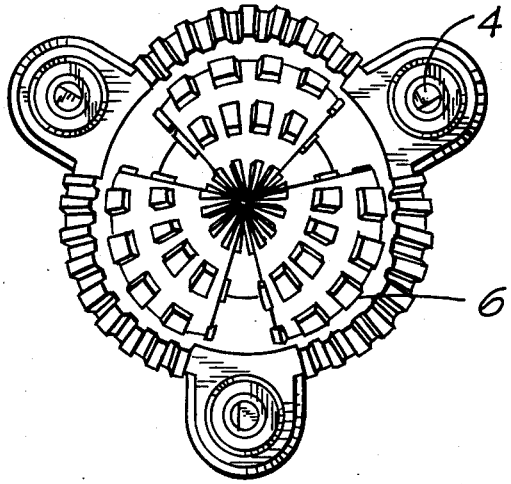

FIGS. 4 and 5 exemplify a drilling tool having three of the interference elements, preferably arranged symmetrically about 3 × 120°, as shown, the already described parts 1 through 3 and 5 through 7 being essentially as in FIGS. 1 to 3 (only in FIG. 4 the bottom portions of FIGS. 1 and 3 are shown at the top, reversed along the vertical axis).

The cavity resonator, such as shown at 5, can have one or several parts, for constructional considerations. Each element 4 disturbs the flow of the flushing medium and produces turbulence.

The provision of the inventive interference element 4 allows to dispense with the customary heavy elements (some exceeding 100 pounds), and to use energy only for modulating the flushing medium when it leaves the drill bit, and the roller cone. It may be noted that it is not necessary in the inventive process and apparatus to divert a portion of the medium through separate passages because such a liquid portion would actually hinder and possibly prevent the drill cuttings to be brought to the surface. Neither the fluid flow has to be switched to another channel, nor the flow phase has to be inverted in the channels.

When superposing the ultrasonic frequency on the static pressure of the filling liquid, the pressure of the liquid, concentrated at the bottom of the borehole, is periodically changed. This effect is due to the exciting effect, which changes the flow conditions in the flowing medium, by the provision of the interference element 4 which, in cooperation with the cavity resonator 5, produces an oscillation in the medium and provides for a modulation to the selected ultrasonic frequency. By "modulation" it should be understood that the laminar flow of the flushing medium is disturbed, and the earlier-mentioned periodic pressure wave (modulation as it were) is superposed on the static pressure of the flowing medium.

The frequency is between 20 and 100 kHz according to the invention, as against the customary range of 30 to 1000 kHz used in previous arrangements. The preferred frequency according to the invention is 27 kHz.

The apparatus according to the invention forces the vibrations, excited in the rock-breaking element and in its surroundings, into the rock and thus changes the internal stress conditions therein so that the stresses in the rigid rock, arising from the excited vibrations and from the rock-breaking element, together considerably exceed the breaking strength, whereby the efficiency of rock fracture increases, the duration of drilling decreases, and the life of the rock-breaking element increases.

It will be understood from the foregoing that the frequency of the produced pressure wave is equal to one of the peak frequencies that can be measured, out of those constituting the earlier-explained periodical, non-sinusoidal curve, or equal to an integral multiple of that frequency. Since natural frequencies of drill bits are generally integral multiples of each other, a pressure wave equal to one of the frequencies is automatically equal to different integral multiples of the other natural frequencies.

EXAMPLE

With a nozzle diameter of 14 millimeters, and with the mentioned A-1 type roller bit of 8½ inch, in the event of 1700 liters per minute flushing performance or capacity of a medium of 1.32 kp per cu.decimeter specific weight and a flow resistance of 25 dynes per sq.centimeter, the diameter of the cavity resonator or chamber 5 should be 22 millimeters and its length 30 mm. The frequency of the ultrasound so produced is 27 kHz. The data given in this example relate to the inventive process being carried out in sand and clayey marle-containing layers, but data to other strata are similar.

In the tool shown in FIGS. 1 to 3 of the drawing, there is one interference element 4 but in drilling tools having three rock-breaking elements or roller cones, there may be three of them as shown in FIGS. 4 and 5. The loss in flow pressure encountered in the interference elements amounts to 25 to 30 att (as is well known, "at" or sometimes "att" stands in the metric technical system for a unit of pressure equal to one kilogram-force per square centimeter). This arrangement means that 50 to 60 HP of output are transformed into the vibratory energy which is used for the rock breaking.

As shown, the cavity resonator 5 has, by way of an example, three distinct portions, contributing to the required loss of pressure in the flow of the flushing medium.

In the course of treating underground strata, under the effect of the periodical, high-intensity, preferably ultrasonic pressure waves generated by the inventive apparatus, or by a variant that can be made without a rock-breaking element, the following occurs:

*a/* clay minerals, tumefied as a result of the well operations described above, are disintegrated and they fall apart;

*b/* adhesive bindings between the rock and the connate water as well as between the former and filtrates become unstable;

*c/* thus undesirable materials that reduce permeability are freed; and

*d/* as a result of an appropriate hydrostatic pressure created in the borehole, and/or a pressure gradient established in the strata by modern technological intervention, these materials can be transferred to a position which is neutral from the viewpoint of production and in which permeability is not reduced any more.

Two kinds of strata treating processes can be performed with the use of the inventive apparatus:

1. Before casing, under the protection of the hydrostatic pressure of filling-up liquid of appropriate density and composition, the treatment is performed with an ultrasonic strata treatment apparatus operated with a medium of a composition identical with that of the filling liquid, the apparatus being adapted to the strata depth and orientation determined by previous investigations and being oriented parallel with the direction of the strata.

In determining the composition of the liquid, regards should be had to the rheology to be formed in the so-called fluid whistle 4, the density to ensure the necessary hydrostatic pressure and the chemical conditions which are to be formed on the basis of the knowledge of the strata structure acquired from core samples. All these tasks are achievable without difficulty with currently employed mud-drilling processes.

In the course of the strata treatment, the drilling spindle provided with the ultrasonic device is gradually allowed to descend to the strata depth strata known the previous from investigations and, if necessary, the treatment is interrupted to extend the spindle. In an apparatus with a 8½ inch roller bit at a depth of 3000 meters, the required pump pressure is 80 to 100 att and the required liquid flow rate is 20 liters per second.

2. A treatment after casing, cementing and perforation is in essence the same as the just described treatment before casing. The process is started at the upper point of the perforation depth and the casing is gradually let down. In the course of the treatment the coarsely accurate adjustment of the vibrational frequency, adjusted to the harmonics of the natural frequency of the cavities resulting from the perforation, is ensured by using variously dimensioned exchangeable cavity resonators, and within that by the expedient choice of the rheology of the medium.

Although the inventive process and apparatus may be defined, in short, as being "for ultrasonic drilling", it will be understood from the preceding explanations that the necessary treatments and steps are of course included in the spirit and scope of the desired patent protection.

It is an advantage of the drilling process and apparatus according to the invention that the mechanical rate of drilling can be doubled at an unchanged tool life. (For a process with identical mounting and demounting, the rate of advance is doubled). The use of the process does not require significant modifications in current technology.

The advantages of the process for strata treatment according to the invention are the following: it can be concentrated on the strata; no aggressive medium is employed; it provides for a greater improvement in permeability than earlier processes; and it makes secondary production more efficient.

It should be understood, of course, that the foregoing disclosure relates only to preferred embodiments of the inventive process and apparatus, and that it is intended to cover all changes and modifications of the examples described which do not constitute departures from the spirit and scope of the invention.

What we claim is:

1. A process for ultrasonic drilling in underground rocky strata with a mechanical drilling tool such as a rotary drill bit containing at least one rock-breaking element, comprising the steps of; making a flushing medium flow through a passageway in the drilling tool; superposing a pressure wave on the static pressure of the flowing medium at the location of rock breaking; and setting the frequency of the pressure wave in the ultrasonic range, between 20 and 100 kHz; wherein the frequency of the pressure wave is equal to at least the natural frequency of the at least one rock-breaking element.

2. The drilling process as defined in claim 1, wherein the frequency of the pressure wave is set to an integral multiple of the natural frequency of the rock-breaking element.

3. A process for ultrasonic drilling in underground rocky strata with a mechanical drilling tool such as a rotary drill bit containing at least one rock-breaking element, comprising the steps of: making a flushing medium flow through a passageway in the drilling tool; superposing a pressure wave on the static pressure of the flowing medium at the location of rock breaking; setting the frequency of the pressure wave in the ultrasonic range, between 20 and 100 kHz; providing a passageway in the drilling tool for the flushing medium, a portion of the passageway constituting a resonance chamber; and disposing at least one interference element above the chamber; wherein the interference element is set to the pressure wave in the ultrasonic range; and wherein the flushing medium is made to flow through the passageway with a volume of approx. 1700 liters per minute, the medium having a specific weight of approx. 1.32 kg/cu.dm and a flow resistance of 25 dynes/sq.cm, the loss of pressure of the medium in passing by the at least one interference element being between 25 and 30 atmospheres.

4. An apparatus for ultrasonic drilling in underground rocky strata with a mechanical drilling tool such as a rotary drill bit having at least one rock-breaking element such as a roller cone, the apparatus comprising: a main passageway in the drilling tool for a flushing medium; at least one resonance chamber constituted by an outer portion of said passageway; and at least one interference element disposed in the drilling tool between said main passageway and said outer portion thereof; said resonance chamber and said interference element constituting means for producing in the medium a pressure wave, for superposing the latter on the static pressure of the medium at the location of rock breaking, and for setting the frequency of the pressure wave in the ultrasonic range, between 20 and 100 kHz; wherein the frequency of the pressure wave is equal to at least the natural frequency of said at least one rock-breaking element.

5. The drilling apparatus as defined in claim 4, wherein the frequency of the pressure wave is set to an integral multiple of the natural frequency of said at least one rock-breaking element.

6. An apparatus for ultrasonic drilling in underground rocky strata with a mechanical drilling tool such as a rotary drill bit having at least one rock-breaking element such as a roller cone, the apparatus comprising: a main passageway in the drilling tool for a flushing medium; at least one resonance chamber constituted by an outer portion of said passageway; and at least one interference element disposed in the drilling tool between said main passageway and said outer portion thereof; said resonance chamber and said interference element constituting means for producing in the medium a pressure wave, for superposing the latter on the static pressure of the medium at the location of rock breaking, and for setting the frequency of the pressure wave in the ultrasonic range, between 20 and 100 kHz; wherein three of said interference elements are comprised in the drilling tool, constituting a total loss of pressure of the medium between 25 and 30 atmospheres.

7. An apparatus for ultrasonic drilling in underground rocky strata with a mechanical drilling tool such as a rotary drill bit having at least one rock-breaking element such as a roller cone, the apparatus comprising: a main passageway in the drilling tool for a flushing medium; at least one resonance chamber constituted by an outer portion of said passageway; and at least one interference element disposed in the drilling tool between said main passageway and said outer portion thereof; said resonance chamber and said interference element constituting means for producing in the medium a pressure wave, for superposing the latter on the static pressure of the medium at the location of rock breaking, and for setting the frequency of the pressure wave in the ultrasonic range, between 20 and 100 kHz; wherein said resonance chamber opens into a jet nozzle forming part of the drilling tool.

8. The drilling apparatus as defined in claim 7, wherein said drilling tool is in the form of a roller bit of 8½ inches and said jet nozzle has a diameter of approximately 14 millimeters.

9. An apparatus for ultrasonic drilling in underground rocky strata with a mechanical drilling tool such as a rotary drill bit having at least one rock-breaking element such as a roller cone, the apparatus comprising: a main passageway in the drilling tool for a flushing medium that is applied with a predetermined static pressure; at least one resonance chamber constituted by an outer portion of said passageway; and at least one interference element disposed in the drilling tool between said main passageway and said outer portion thereof; said resonance chamber and said interference element constituting means for changing the flow conditions of at least part of the medium from laminar to turbulent, producing in the medium a pressure wave, for superposing the latter on the static pressure of the medium at the location of rock breaking, and for setting the frequency of the pressure wave in the ultrasonic range, between 20 and 100 kHz.

10. The drilling apparatus as defined in claim 9, wherein the diameter of said resonance chamber is approximately 22 millimeters, its length is approximately 30 mm, and the pressure wave is set to approx. 27 kHz.

* * * * *